US008875721B2

(12) United States Patent
Bertsch et al.

(10) Patent No.: US 8,875,721 B2
(45) Date of Patent: Nov. 4, 2014

(54) DISHWASHER WITH CLOSED LOOP CONDENSER

(75) Inventors: Roger J. Bertsch, Stevensville, MI (US); Keeley M. Kabala, Elgin, IL (US); Rafael C. Melo, Joinville (BR); Alvaro Vallejo Noriega, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 233 days.

(21) Appl. No.: 13/327,083

(22) Filed: Dec. 15, 2011

(65) Prior Publication Data

US 2013/0152981 A1 Jun. 20, 2013

(51) Int. Cl.
*A47L 15/48* (2006.01)

(52) U.S. Cl.
USPC ..... 134/107; 134/56 D; 134/57 D; 134/58 D; 134/90; 134/105

(58) Field of Classification Search
CPC ..... A47L 15/48; A47L 15/481; A47L 15/483; A47L 15/485; A47L 15/486; A47L 15/488
See application file for complete search history.

(56) References Cited

U.S. PATENT DOCUMENTS

| | | | | |
|---|---|---|---|---|
| 3,068,877 | A * | 12/1962 | Jacobs | 134/99.1 |
| 3,876,469 | A | 4/1975 | Schimke | |
| 5,875,802 | A | 3/1999 | Favaro et al. | |
| 6,578,591 | B1 | 6/2003 | Eksert et al. | |
| 7,445,013 | B2 | 11/2008 | VanderRoest et al. | |
| 7,523,758 | B2 | 4/2009 | Vanderroest et al. | |
| 2006/0096621 | A1 | 5/2006 | Lee et al. | |
| 2007/0251552 | A1 | 11/2007 | Lee | |
| 2008/0210279 | A1 | 9/2008 | Hildenbrand | |
| 2008/0264455 | A1 | 10/2008 | Brewer et al. | |
| 2008/0264458 | A1 * | 10/2008 | Berner et al. | 134/57 D |
| 2009/0038661 | A1 * | 2/2009 | Hildenbrand | 134/56 D |
| 2010/0043250 | A1 | 2/2010 | Berends et al. | |
| 2010/0294323 | A1 | 11/2010 | Brunswick et al. | |
| 2011/0126864 | A1 | 6/2011 | Kim | |

FOREIGN PATENT DOCUMENTS

| | | | |
|---|---|---|---|
| CH | 693494 | A5 | 9/2003 |
| DE | 19946456 | A1 | 4/2001 |
| DE | 10058188 | A1 | 5/2002 |
| DE | 102006042486 | B3 | 11/2007 |
| DE | 102007007133 | A1 | 8/2008 |
| DE | 102008040745 | A1 | 1/2010 |
| DE | 102010002086 | A1 | 8/2011 |
| DE | 102010029888 | A1 | 12/2011 |
| EP | 0374616 | B1 | 6/1990 |

(Continued)

OTHER PUBLICATIONS

German Search Report for Counterpart DE102012025591, May 2, 2013.
German Search Report for Counterpart DE102012109784, Apr. 29, 2013.

*Primary Examiner* — Joseph L Perrin
*Assistant Examiner* — LeVon J Shahinian

(57) ABSTRACT

A dishwasher with a closed loop condenser having a moist air conduit, a dry air conduit having a portion in overlying relationship with a portion of the moist air conduit, wherein the overlying portions of the moist air conduit and the dry air conduit form a heat exchanger, and a controllable gate for selectively introducing, exhausting, or redirecting air relative to the condenser.

10 Claims, 5 Drawing Sheets

(56) References Cited

FOREIGN PATENT DOCUMENTS

| | | | |
|---|---|---|---|
| EP | 1013217 | A1 | 6/2000 |
| EP | 1447042 | B1 | 8/2004 |
| EP | 2332457 | A1 | 6/2011 |
| JP | 2008279026 | A | 11/2008 |
| KR | 20050014516 | A | 2/2005 |
| WO | 2010073185 | A1 | 7/2010 |
| WO | 2011147683 | A1 | 12/2011 |

* cited by examiner

DISHWASHER WITH CLOSED LOOP CONDENSER

BACKGROUND OF THE INVENTION

Dishwashers can include a drying system for drying dishes in a treating chamber of the dishwasher. Such drying systems can rely on a static dry, in which dry air from the exterior of the dishwasher flows into the treating chamber to replace some of the moist air, which aids in the evaporation of moisture from the dishes. This drying process can be accelerated by the use of a heater which emits heat to speed the evaporation of moisture. Other drying systems rely upon a closed loop condenser for removing moisture from a treating chamber of the dishwasher during a drying cycle of the dishwasher. Such closed loop condensers have a heat exchanger which cools the moist air in the treating chamber with dry ambient air, and thereby precipitates the moisture from the moist air.

SUMMARY OF THE INVENTION

The invention relates to an apparatus including a dishwasher having a tub at least partially defining a treating chamber with an open side, a cover selectively closing the open side, and a closed loop condenser. The closed loop condenser can comprise a moist air conduit fluidly coupling one portion of the treating chamber to another portion of the treating chamber, a dry air conduit fluidly coupled to the ambient air and having a portion in overlying relationship with a portion of the moist air conduit, wherein the overlying portions of the moist air conduit and the dry air conduit form a heat exchanger to cool the moist air in the moist air conduit and thereby precipitate the moisture from the moist air, and a controllable gate.

DESCRIPTION OF EMBODIMENTS OF THE INVENTION

The invention is generally directed toward the drying of utensils in a dishwasher. The particular approach of the invention is to provide a condenser with a controllable gate which will introduce, exhaust, or redirect air in order to reduce drying time.

Figure 1:
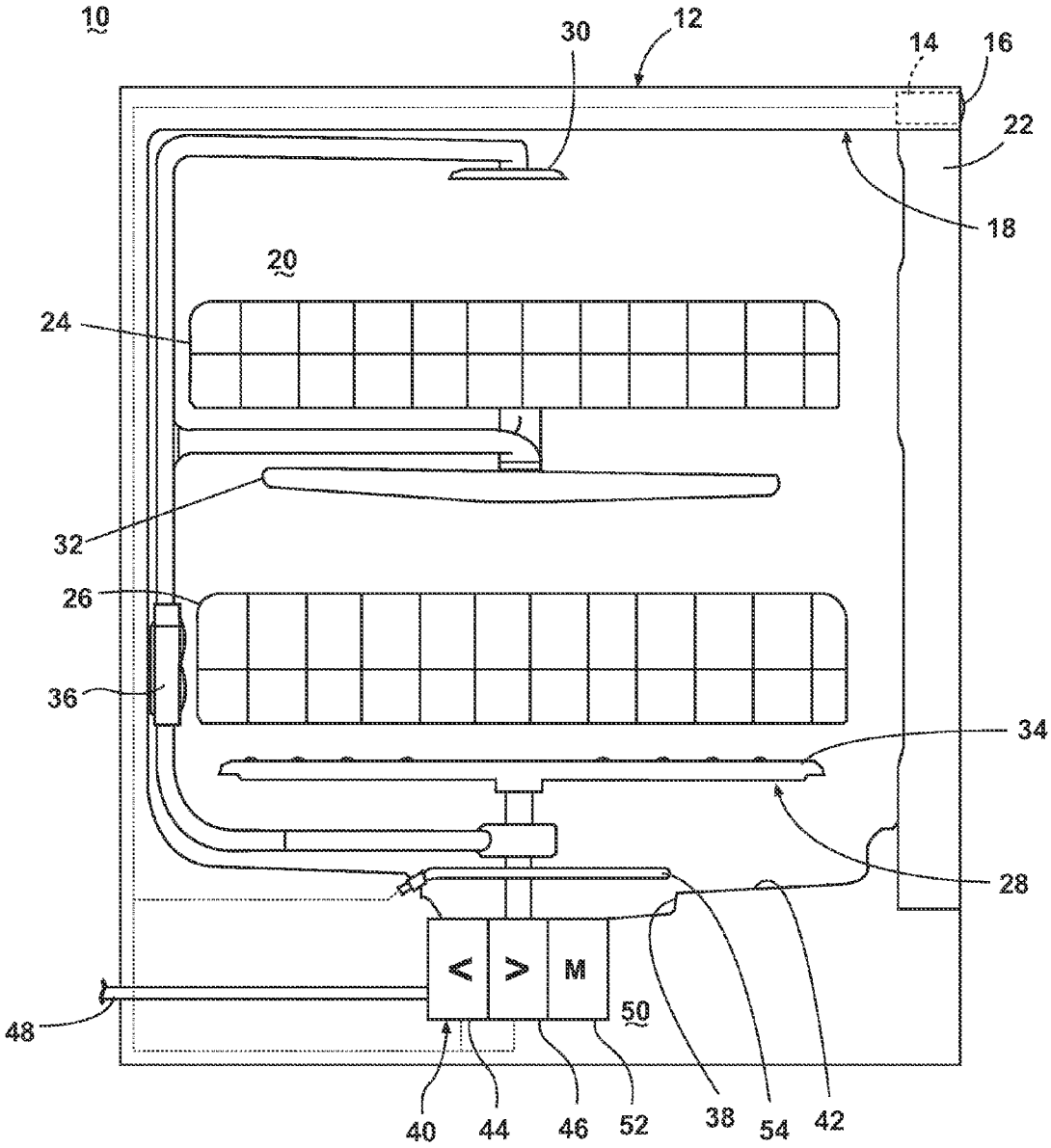
FIG. 1 is a schematic, side view of a dishwasher according to a first embodiment of the invention.

FIG. 1 is a schematic, side view of a dishwasher 10 according to a first embodiment of the invention, the dishwasher 10 having a cabinet 12 defining an interior. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the cabinet 12 and at least partially defines a treating chamber 20 with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Utensil holders in the form of upper and lower racks 24, 26 are located within the treating chamber 20 and receive utensils for being treated. The racks 24, 26 are mounted for slidable movement in and out of the treating chamber 20 for ease of loading and unloading. As used in this description, the term "utensil(s)" is intended to be generic to any item, single or plural, that may be treated in the dishwasher 10, including, without limitation; dishes, plates, pots, bowls, pans, glassware, and silverware. While not shown, additional utensil holders, such as a silverware basket on the interior of the door 22 or a third level rack above the upper rack 24 may also be provided.

A spraying system 28 may be provided for spraying liquid into the treating chamber 20 and is illustrated in the form of an upper sprayer 30, a mid-level sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18. Suitable spray manifolds are set forth in detail in U.S. Pat. No. 7,445,013, filed Jun. 17, 2003, and titled "Multiple Wash Zone Dishwasher," and U.S. Pat. No. 7,523,758, filed Dec. 30, 2004, and titled "Dishwasher Having Rotating Zone Wash Sprayer," both of which are incorporated herein by reference in their entirety.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recess portion of a bottom wall 42 of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system 28 to supply liquid into the treating chamber 20. While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

A motor compartment 50 may be provided beneath the sump 38 and may be separated from the treating chamber 20 by the bottom wall 42. The motor compartment 50 contains one or more heat-emitting component(s), shown herein as including the pump assembly 40 and at least one motor 52 for driving the pump assembly 40. Other heat-emitting components can also be included in the motor compartment 50, such as additional motors and controllers. As shown herein, a single motor 52 can be configured to drive both the drain pump 44 and the recirculation pump 46. Alternatively, separate motors can be provided for the drain pump 44 and the recirculation pump 46. The heat-emitting components, like the pump assembly 40 and motor 52, emit heat that warms the surrounding air to create warm air within the motor compartment 50.

A heating system having a heater 54 may be located within or near the sump 38 for heating liquid contained in the sump 38. Alternatively, the heater 54 may be located within the motor compartment 50 for heating liquid flowing into or out of the recirculation pump 46. In the latter case, the heater 54 would be considered a heat-emitting component. A filtering system (not shown) may be fluidly coupled with the recirculation flow path for filtering the recirculated liquid.

Figure 2:
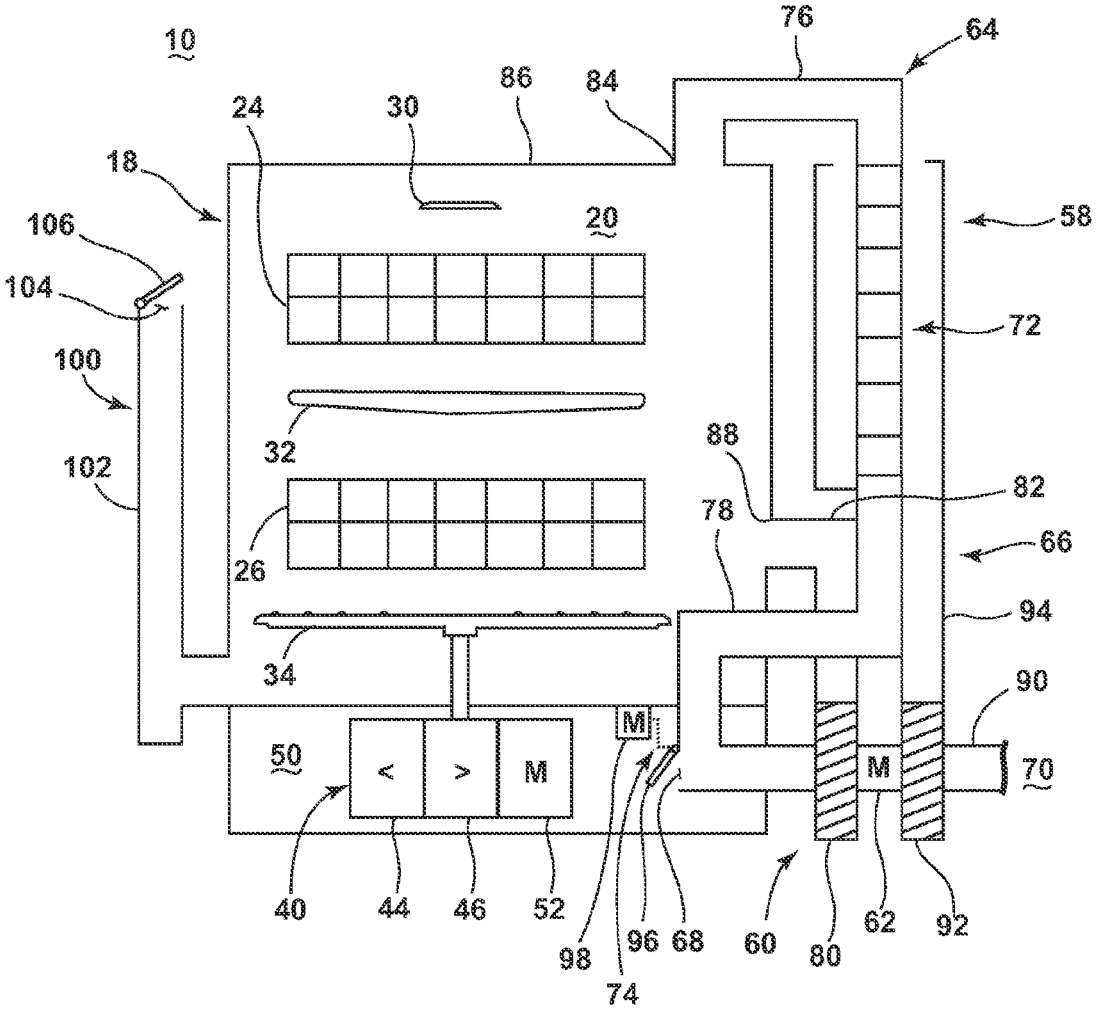
FIG. 2 is a schematic, front view of the dishwasher of FIG. 1.

FIG. 2 is a schematic, front view of the dishwasher 10 of FIG. 1. A closed loop drying system may be provided for removing moisture from the treating chamber 20 during a drying cycle of the dishwasher 10. The drying system includes a closed loop condenser 58 having a fan 60 driven by a motor 62, a moist air conduit 64, and a dry air conduit 66. The moist air conduit 64 fluidly couples one portion of the treating chamber 20 to another portion of the treating chamber 20, and includes a warm air inlet 68 selectively fluidly coupled to the warm air created by at least one of the heat-emitting component(s) within the motor compartment 50. Alternatively, the inlet 68 can be selectively fluidly coupled to warm air from a heat-emitting component outside the motor compartment 50 or in another location in the dishwasher 10. The dry air conduit 66 is fluidly coupled to the ambient air 70 (i.e. air from the environment exterior of the dishwasher 10) and includes a portion in overlying relationship with a portion of the moist air conduit 64, wherein the overlying portions of the moist air conduit 64 and the dry air conduit 66 form a heat exchanger 72 to cool the moist air in the moist air conduit 64 and thereby precipitate the moisture from the moist air. The dry air conduit 66 is fluidly separate from the treating chamber 20 and the moist air conduit 64. A controllable gate 74 selectively opens the warm air inlet 68 of the moist air conduit 64 to effect a supply of the warm air to the moist air conduit 64, wherein the warm air may be supplied to the treating chamber 20.

The moist air conduit 64 includes an inlet segment 76 upstream of the heat exchanger 72, an intermediate segment 78 downstream of the heat exchanger 72 and upstream of a first stage 80 of the fan 60, and an outlet segment 82 downstream of the first stage 80. The inlet segment 76 includes an inlet opening 84 in fluid communication with a first portion treating chamber 20 for delivering moist air from the treating chamber 20 to the heat exchanger 72. As shown herein, the inlet opening 84 can be formed in an upper wall 86 of the tub 18, although other locations are possible. The intermediate segment 78 extends from the heat exchanger 72 to the first stage 80 of the fan 60. A portion of the intermediate segment 78 can extend through the motor compartment 50, and can include the warm air inlet 68 and controllable gate 74 to position the inlet 68 in selective fluid communication with the warm air with the motor compartment 50. The outlet segment 82 includes an outlet opening 88 in fluid communication with a second portion of the treating chamber 20 for delivering warm air to the treating chamber 20 from the motor compartment 50. By "warm air", it is meant that the air is at a higher temperature than the ambient air 70. Typically, the air in the motor compartment is approximately 4° C. warmer than the ambient air 70, at least when the gate 74 is initially opened. The warm air is also normally dryer than the air in the treating chamber 20, at least when the gate 74 is initially opened.

The dry air conduit 66 includes an inlet segment 90 upstream of a second stage 92 of the fan 60 and an outlet segment 94 downstream of the second stage 92. The inlet segment 90 is in fluid communication with the ambient air 70 in order to supply dry air to the heat exchanger 72, which is formed by a portion of the outlet segment 94 that extends over a portion of the moist air conduit 64. By "dry air", it is meant that the air has a lower moisture content relative to the air in the treating chamber 20. The dry air is also normally cooler and has a lower temperature than the air in the treating chamber 20.

The controllable gate 74 can comprise a valve 96 for closing the warm air inlet and a motor 98 for driving the movement of the valve 96. The motor 98 can be a wax motor or any other suitable type of motor for moving the valve 96. The motor 98 can be coupled with the controller 14 (FIG. 1) for selectively opening and closing the warm air inlet 68.

The dishwasher 10 can further include a regeneration system 100 for regenerating softening agents used by a water softener (not shown) and having a regeneration tank 102 in fluid communication with the treating chamber 20. The regeneration tank 102 can include a vent 104 that is fluidly coupled with the ambient air 70 which permits excess air in the regeneration tank 102 or treating chamber 20 to be exhausted from the dishwasher 10. The vent 104 can be pressure-activated or can be selectively closed by a controllable closure means, such as a valve 106. Alternatively, if no regeneration system is provided with the dishwasher 10, excess air in the treating chamber 20 can be exhausted from the dishwasher 10 via seals around the door 22 (FIG. 1), which can be configured to open at a certain pressure differential between the treating chamber 20 and the environment, or other openings in the cabinet 12.

In operation, moist air is formed in the treating chamber 20 by a washing, rinsing, or sanitizing cycle. To dry the dishes, a drying cycle can be initiated, in which the first stage 80 of the fan 60 pulls moist air from the treating chamber 20 into the moist air conduit 64 via the inlet opening 84, and the second stage 92 of the fan 60 pulls dry air from the ambient air 70 into the dry air conduit 66. The moist air passes through the heat exchanger 72, which precipitates moisture from the moist air. The condensed moisture drips down from the heat exchanger 72 and back into the tub 18, and can thereafter be drained from the dishwasher.

The efficiency of the condensation depends on a temperature differential between the moist air conduit 64 and the dry air conduit 66. At the beginning of the drying cycle, the moist air can have a temperature of approximately 45-68° C. This temperature may be dependent on the regulations of the geographical region in which the dishwasher 10 is installed; for example, a dishwasher in the United States may have a higher moist air temperature than a dishwasher in Europe at the beginning to a drying cycle. As the temperature of the moist air within the treating chamber 20 decreases (i.e. as it approaches the temperature of the ambient air 70), which will happen naturally due to heat transfer to the exterior of the dishwasher 10 after the washing, rinsing, or sanitizing cycle ends, the temperature differential decreases, lowering the efficiency of the condenser 58. This increases the length of time needed to dry the dishes in the treating chamber.

In the first embodiment of the invention, the controllable gate 74 can be opened to allow warm air from a heat-emitting component, such as the pump assembly 40 and/or motor 52, in the motor compartment 50 to enter the moist air conduit 64, and be passed into the treating chamber 20. The warm air can have a lower humidity than the moist air, and can help evaporate any remaining moisture on dishes in the treating chamber 20 by absorbing some of the humidity in the moist air. As warm air is introduced into the moist air conduit 64, and thus into the treating chamber 20, excess air in the treating chamber 20 may be exhausted via the vent 104 of the regeneration system 100 or through other openings in the treating chamber 20.

One example of a drying cycle for use by the first embodiment of the dishwasher 10 includes three phases. In a first or static phase, excess water drips from the dishes in the treating chamber for a given time period, which may be approximately 5-10 minutes. In the static phase, the fan motor 62 is not active, and the controllable gate 74 and vent 104 may be closed. In a second or active condensing phase, the fan motor 62 is activated, drawing air through the condenser 58. During the active condensing phase, a majority of the moisture of the moist air in the treating chamber 20 can be condensed. For example, approximately 65-86% of the moisture in the moist air can be condensed in the active condensing phase. This phase may last approximately 25-40 minutes, or until a predetermined condition in the treating chamber 20 is reached. The predetermined condition may be a predetermined humidity, such as less than 30 g/m$^3$, in the treating chamber 20 or a moisture content of the moist air. In the third or gate-open phase, the controllable gate 74 is opened to draw warm air into the moist air conduit 64. During the gate-open phase, the remaining moisture of the moist air in the treating chamber 20 can be condensed. This phase may last approximately 15-30 minutes, or until a predetermined condition in the treating chamber 20 is reached. The predetermined condition may be a condition at which the door 22 (FIG. 1) may be opened to release any remaining moisture from the dishwasher 10, such as a predetermined humidity in the treating chamber 20, such as less than 15 g/m$^3$, or a moisture content of the moist air.

Figure 3:
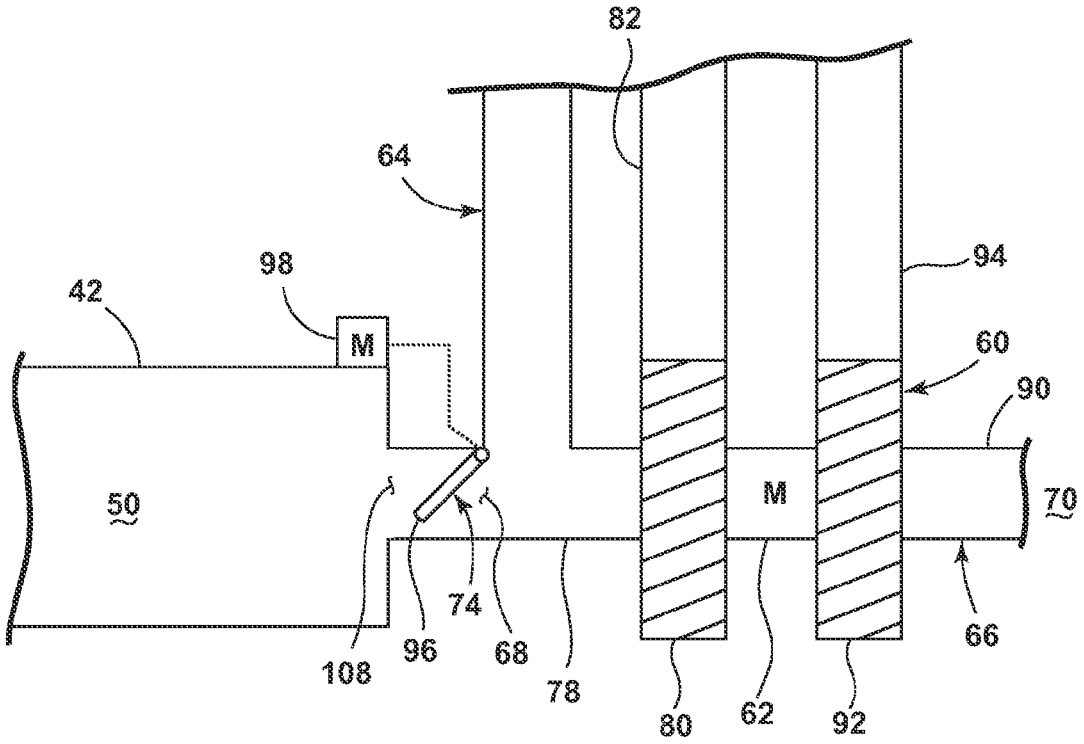
FIG. 3 is a schematic, partial view of a dishwasher according to a second embodiment of the invention.

FIG. 3 is a schematic illustration of a second embodiment of the dishwasher 10. The second embodiment can be substantially identical to the first embodiment shown in FIG. 2, with the exception that the intermediate segment 78 does not extend through the motor compartment 50, such that the motor compartment 50 is isolated from both the treating chamber 20 and the closed loop condenser 58. In this case, the motor compartment 50 can have an outlet 108 aligned with the warm air inlet 68. The controllable gate 74 can selectively open the outlet 108 or the inlet 68 in order to provide warm air to the moist air conduit 64. The operation of the second embodiment can be substantially identical to the operation described above for the first embodiment, and the dishwasher 10 can be controlled according to the exemplary three-phase drying cycle described above.

Figure 4:
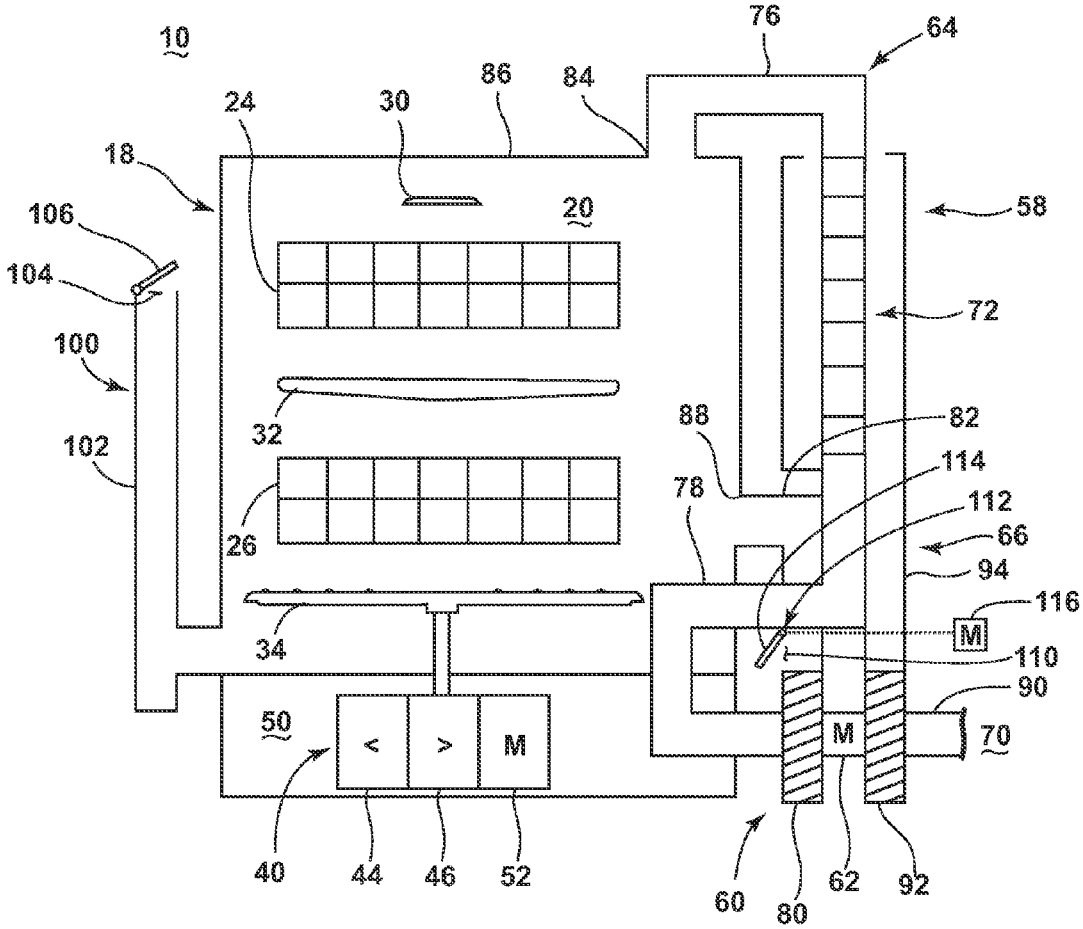
FIG. 4 is a schematic, front view of a dishwasher according to a third embodiment of the invention.

FIG. 4 is a schematic illustration of a third embodiment of the dishwasher 10. The third embodiment can be substantially identical to the first embodiment shown in FIG. 2, with the exception that the moist air conduit 64 has an exhaust outlet 110 in fluid communication with the ambient air 70 and a controllable gate 112 is positioned to selectively open the exhaust outlet 110 to discharge a portion of the moist air from the moist air conduit 64. The exhaust outlet 110 can be provided on the outlet segment 82 of the moist air conduit 64 downstream of the first fan stage 80. The controllable gate 112 can comprise a valve 114 for closing the exhaust outlet 110 and a motor 116 for driving the movement of the valve 114, and can be similar to the controllable gate 74 described for the first embodiment. The motor 116 can be coupled with the controller 14 (FIG. 1) for selectively opening and closing the exhaust outlet 110.

The dishwasher 10 of the third embodiment may initially operate in the same manner as the dishwasher 10 of the first embodiment. However, in the third embodiment, the controllable gate 112 can be opened to allow moist air from the moist air conduit 64 to be discharged from the dishwasher 10, thereby removing some of the remaining moisture. As moist air is exhausted from the moist air conduit 64, new replacement air may be supplied to the treating chamber 20 via the vent 104 of the regeneration system 100 or through other openings in the treating chamber 20. The vent 104 may open by pressure-activation, or by activating the motor 116 to open to the valve 114. The new, replacement air has a lower moisture content than the moist air in the treating chamber 20, and can therefore absorb the remaining humidity in the moist air. The new, replacement air can also help evaporate any remaining moisture on dishes in the treating chamber 20. As new, replacement air continues to be introduced, the remaining moisture will be diffused.

One example of a drying cycle for use by the third embodiment of the dishwasher 10 includes three phases, including a first or static phase and a second or active condensing phase, as previously described with respect to the first embodiment. For the third embodiment, in the third or gate-open phase, the controllable gate 112 is opened to exhaust moist air from the moist air conduit 64, and the vent 104 of the regeneration system 100 is opened to introduce new, replacement air into the treating chamber 20. During the gate-open phase, the remaining moisture of the moist air in the treating chamber 20 can be absorbed by the new, replacement air. This phase may last approximately 15-30 minutes, or until a predetermined condition in the treating chamber 20 is reached. The predetermined condition may be a condition at which the door 22 (FIG. 1) may be opened to release any remaining moisture from the dishwasher 10, such as a predetermined humidity in the treating chamber 20, such as less than 15 g/m$^3$, or a moisture content of the moist air.

Figure 5:
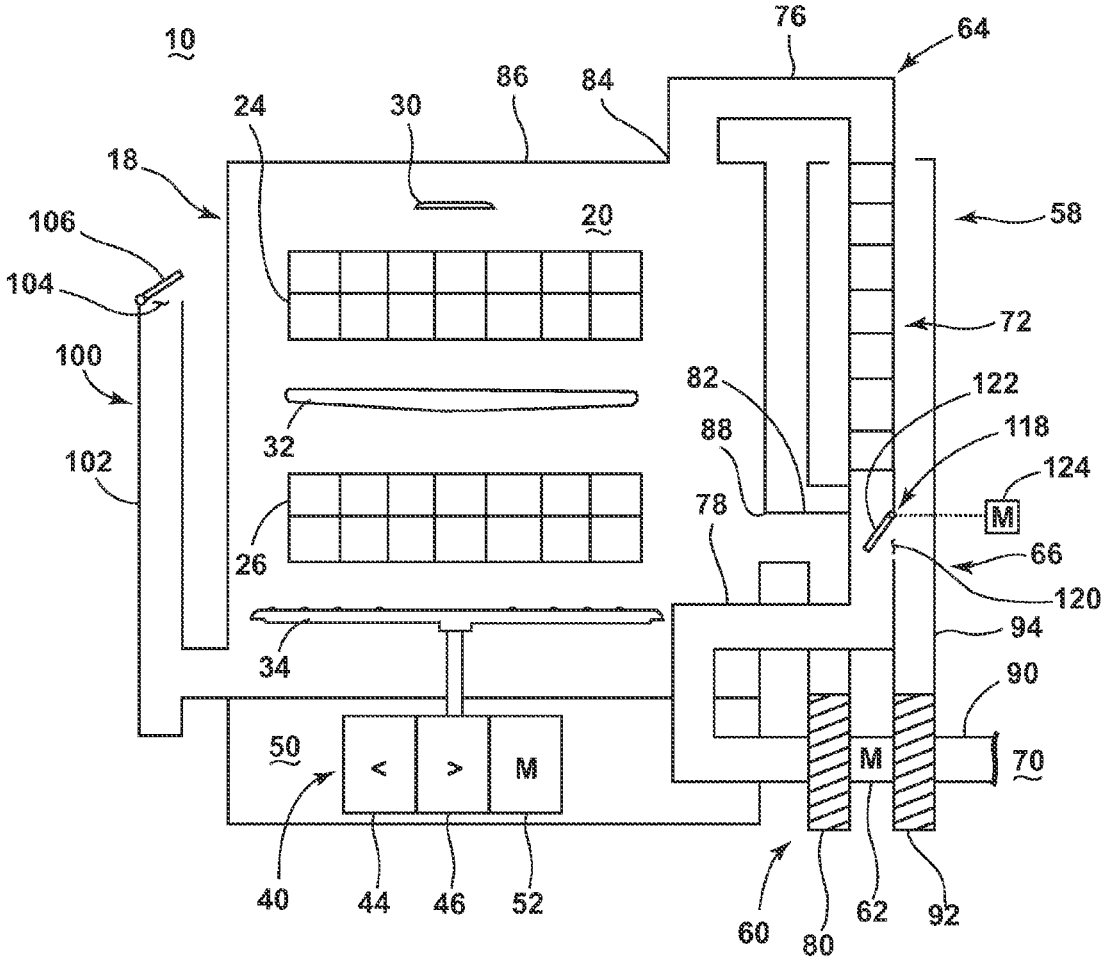
FIG. 5 is a schematic, front view of a dishwasher according to a fourth embodiment of the invention.

FIG. 5 is a schematic illustration of a fourth embodiment of dishwasher 10. The fourth embodiment can be substantially identical to the first embodiment shown in FIG. 2, with the exception that a controllable gate 118 is provided for selectively fluidly coupling the dry air conduit 66 to the moist air conduit 64 to effect a supply of dry air to the moist air conduit 64, such that the dry air may be supplied to the treating chamber 20. A passage 120 between the moist and dry air conduits 64, 66 can be closed by the controllable gate 118. The controllable gate 118 can comprise a valve 122 for closing the passage 120 and a motor 124 for driving the movement of the valve 122, and can be similar to the controllable gate 74 described for the first embodiment. The motor 124 can be coupled with the controller 14 (FIG. 1) for selectively opening and closing the passage 120.

The dishwasher 10 of the fourth embodiment may initially operate in the same manner as the dishwasher 10 of the first embodiment. However, in the fourth embodiment, the controllable gate 118 can be opened to allow dry air from the dry air conduit 66 into the moist air conduit 64 via the passage 120. The dry air has a lower moisture content than the moist air in the treating chamber 20, and can therefore absorb the remaining humidity in the moist air. The dry air can also help evaporate any remaining moisture on dishes in the treating chamber 20. As dry air continues to be introduced, the remaining moisture will be diffused. Furthermore, as dry air is introduced into the moist air conduit 64, and thus into the treating chamber 20, excess air in the treating chamber 20 may be exhausted via the vent 104 of the regeneration system 100 or through other openings in the treating chamber 20.

One example of a drying cycle for use by the fourth embodiment of the dishwasher 10 includes three phases, including a first or static phase and a second or active condensing phase, as previously described with respect to the first embodiment. For the fourth embodiment, in the third or gate-open phase, the controllable gate 118 is opened to pass ambient air 70 into the moist air conduit 64, and the vent 104 of the regeneration system 100 is opened to discharge excess air from the treating chamber 20. The excess air can also be discharged through other openings in the treating chamber 20. During the gate-open phase, the remaining moisture of the moist air in the treating chamber 20 can be absorbed by the new, dry air. This phase may last approximately 15-30 minutes, or until a predetermined condition in the treating chamber 20 is reached. The predetermined condition may be a condition at which the door 22 (FIG. 1) may be opened to release any remaining moisture from the dishwasher 10, such as a predetermined humidity in the treating chamber 20, such as less than 15 $g/m^3$, or a moisture content of the moist air.

The apparatus disclosed herein provides a dishwasher with a condenser with a controllable gate which will introduce, exhaust, or redirect air relative to the condenser. One advantage that may be realized in the practice of some embodiments of the described systems and methods is that the gate 74, 112, 118 can be controlled such that drying time can be reduced, which will reduce the overall cycle time of the dishwasher 10. Reducing drying time has the added effect of reducing power consumption, since components of the drying system such as fans, motors, etc. will operate for a shorter period of time.

Another advantage that may be realized in the practice of some embodiments of the described systems and methods is that warm air from heat-generating components of the dishwasher 10 can be routed into the condenser 58 and utilized to increase the efficiency of the condenser 58, thereby decreasing drying time.

Another advantage that may be realized in the practice of some embodiments of the described systems and methods is that the warm air from the heat-generating components can also be relatively dry, and can be routed into the condenser 58 and utilized to absorb moisture from air in the treating chamber 20, thereby decreasing drying time.

Another advantage that may be realized in the practice of some embodiments of the described systems and methods is that moist air from the condenser 58 can be exhausted to the environment, and drier replacement air can enter the treating chamber 20 via the regeneration tank 102, thereby decreasing drying time.

Another advantage that may be realized in the practice of some embodiments of the described systems and methods is that dry air from the dry air conduit 66 of the condenser can be routed to the moist air conduit 64, thereby decreasing drying time.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher comprising:

a tub at least partially defining a treating chamber with an open side;

a cover selectively closing the open side;

a heat-emitting component warming the surrounding air to create warm air; and a closed loop condenser comprising:

a moist air conduit fluidly coupling a first portion of the treating chamber to a second portion of the treating chamber, and having a moist air inlet fluidly coupled to the first portion, an outlet fluidly coupled to the second portion, and a warm air inlet selectively fluidly coupled to the warm air; and a dry air conduit fluidly coupled to ambient air and having a portion in overlying relationship with a portion of the moist air conduit, wherein the overlying portions of the moist air conduit and the dry air conduit form a heat exchanger to cool moist air in the moist air conduit and thereby precipitate moisture from the moist air; and a controllable gate selectively opening the warm air inlet of the moist air conduit to effect a supply of the warm air to the moist air conduit, wherein the warm air may be supplied to the treating chamber.

2. The dishwasher of claim 1, wherein the heat-emitting component comprises a pump assembly.

3. The dishwasher of claim 1, wherein the heat-emitting component comprises a motor.

4. The dishwasher of claim 1, and further comprising a compartment having an outlet aligned with the warm air inlet of the moist air conduit and selectively closed by the controllable gate, wherein the heat-emitting component is located within the compartment.

5. The dishwasher of claim 4, wherein the compartment is isolated from the treating chamber and closed loop condenser.

6. The dishwasher of claim 4, wherein the compartment is a motor compartment.

7. The dishwasher of claim 1, wherein the controllable gate comprises a motor-driven valve.

8. The dishwasher of claim 1, and further comprising a vent fluidly coupled with the ambient air, wherein excess air in the treating chamber can be exhausted via the vent.

9. The dishwasher of claim 8, and further comprising a softening agent regeneration system fluidly coupled to the treating chamber for regenerating softening agents used by a water softener and comprising the vent.

10. The dishwasher of claim 8, wherein the vent comprises a pressure-activated vent.

* * * * *